US006240568B1

(12) United States Patent
Lee

(10) Patent No.: US 6,240,568 B1
(45) Date of Patent: Jun. 5, 2001

(54) INTERNALLY AND EXTERNALLY ACCESSIBLE DISPLAY MOUNTING APPARATUS FOR CAP OR APPAREL

(76) Inventor: Razgo Lee, 1810 S. Vineyard Avenue, Ontario (CA), 91761

( * ) Notice: Subject to any disclaimer, the term of this patent is extended or adjusted under 35 U.S.C. 154(b) by 0 days.

(21) Appl. No.: 09/406,500

(22) Filed: Sep. 28, 1999

(51) Int. Cl.[7] ..... A42B 1/24
(52) U.S. Cl. ..... 2/209.13; 2/195.1; 40/329
(58) Field of Search ..... 2/209.12, 195.1, 2/209.13, 209.14, 209.3, 195.2, 250, 171

(56) References Cited

U.S. PATENT DOCUMENTS 2,803,829 * 8/1957 Tscharner ..... 2/199
4,625,337 * 12/1986 Zahn ..... 2/82
5,111,366 * 5/1992 Rife et al. ..... 362/31
5,253,368 * 10/1993 Blake ..... 2/209.13
5,359,733 * 11/1994 Brannon et al. ..... 2/195.1
5,452,479 * 9/1995 Mostert ..... 2/195.1
5,465,426 * 11/1995 Beaton ..... 2/195.1
5,509,144 * 4/1996 Soergel et al. ..... 2/195.1
5,548,847 * 8/1996 Spicijaric ..... 2/209.13
5,581,813 * 12/1996 Henschel ..... 2/195.1
5,943,702 * 8/1999 Kronenberger ..... 2/171.1

* cited by examiner

*Primary Examiner*—John J. Calvert
*Assistant Examiner*—Alissa L. Hoey
(74) *Attorney, Agent, or Firm*—Chan Law Group LC; Brett L. Halperin

(57) ABSTRACT

An apparatus for interchangeably displaying on an apparel or a cap, a generally planar item containing informational material imprinted thereon, or otherwise graphical, comprising in combination, a fabric of a cap or of an apparel, a frame assembly, an opening, a generally transparent material, a cell, and a means for inserting a planar item into the cell. The frame assembly is attached to the fabric and includes an opening therein. The transparent layer encompasses the opening and forms the cell between the fabric and the transparent layer. The frame assembly includes a member that borders the cell. The inserting means is in communication with the cell and allows for the insertion and removal of the display item into the cell for display through the opening. It may be seen that the apparatus provides for a more aesthetically pleasing appearance through use of a variety of display items, or otherwise the display of information on a cap or apparel, through the interchangeability of the display item within the apparatus.

2 Claims, 12 Drawing Sheets

INTERNALLY AND EXTERNALLY ACCESSIBLE DISPLAY MOUNTING APPARATUS FOR CAP OR APPAREL

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO A MICROFICHE APPENDIX

Not Applicable

BACKGROUND OF THE INVENTION

1. Field of the Invention

This invention pertains generally to display items, and more particularly, to an apparatus for mounting a display item onto a cap or apparel.

2. Description of the Background Art

In addition to their functional attributes, caps have generally been used as a source of ornamental or informational display. Items such as team logos, company insignias, messages, or miscellaneous advertising information are often seen on caps. Typically, such information is placed onto the crown portion of the cap, either during or after manufacturing the cap, by various methods such as embroidering, stitching, imprinting, glueing, screen printing, or the like. Similarly, such ornamentation is often placed on the fabric of apparel items such as jackets and shirts. Once placed onto the crown portion or fabric of the apparel, these logos, insignias, messages, or advertisements essentially become a permanent part of the cap or apparel, and its removal and/or replacement is virtually impossible, if not extremely time consuming.

Accordingly, there exists a need for the ornamental or informational display on caps and apparel that include means for easily and readily inserting and/or removing an interchangeable display item as desired, without the aforementioned difficulties. The present invention satisfies these needs, as well as others, and generally overcomes the deficiencies described in the background art.

BRIEF SUMMARY OF THE INVENTION

The present invention is an apparatus for displaying on a cap or on an apparel a generally planar item containing informational or otherwise graphical material imprinted thereon, wherein the insertion and removal of the display item may be easily accomplished from either inside the crown portion of the cap or apparel, or outside the crown portion of the cap or the apparel. In general terms, the invention comprises, in combination, a fabric of material of an apparel or crown portion of a cap, a frame assembly, an opening, a generally transparent layer, a cell, and a means for inserting a planar item into the cell.

The frame assembly is attached to the fabric of either the crown portion or apparel item and includes an opening therein. The transparent layer encompasses the opening and forms the cell between the material and the transparent layer. The frame assembly includes a member that borders the cell. The inserting means is in communication with the cell and allows for the insertion of the display item into the cell for display through the opening.

For the insertion of a display item from inside the crown portion of the cap or from inside the apparel, at least one gap exists in the fabric to provide access to the cell. Multiple gaps are contemplated for the display of oversized items. For the insertion of a display item from outside the crown portion or from outside the apparel, at least one aperture exists in the frame member to provide access to the cell. Multiple apertures are also contemplated for the display of oversized items. The member of frame assembly may have shapes such as, but not limited to, rectangle, square, oval, triangle, gold ingot, or heart. The specific shape of the member may be suited to accommodate a correspondingly shaped display item.

An object of the invention is to provide an apparatus for interchanging a display item on a cap or apparel.

Another object of the invention is to provide an apparatus for the insertion and mounting of a display item onto a cap or apparel.

Still another object of the invention is to provide for the insertion and/or removal of a display item from inside an apparel or the crown portion of a cap.

Still another object of the invention is to provide for the insertion and/or removal of a display item from outside the crown portion of a cap or apparel.

Still another object of the invention is to provide an apparatus for the insertion and mounting of a display item having various shapes or sizes onto a cap or apparel.

Further objects and advantages of the invention will be brought out in the following portions of the specification, wherein the detailed description is for the purpose of fully disclosing preferred embodiments of the invention without placing limitations thereon.

BRIEF DESCRIPTION OF THE DRAWINGS

The invention will be more fully understood by reference to the following drawings which are for illustrative purposes only.

DETAILED DESCRIPTION OF THE INVENTION

Referring more specifically to the drawings, for illustrative purposes the present invention is embodied in the apparatus generally shown in FIG. 1 through FIG. 15. It will be appreciated that the apparatus may vary as to configuration and as to details of the parts without departing from the basic concepts as disclosed herein.

Figure 1:
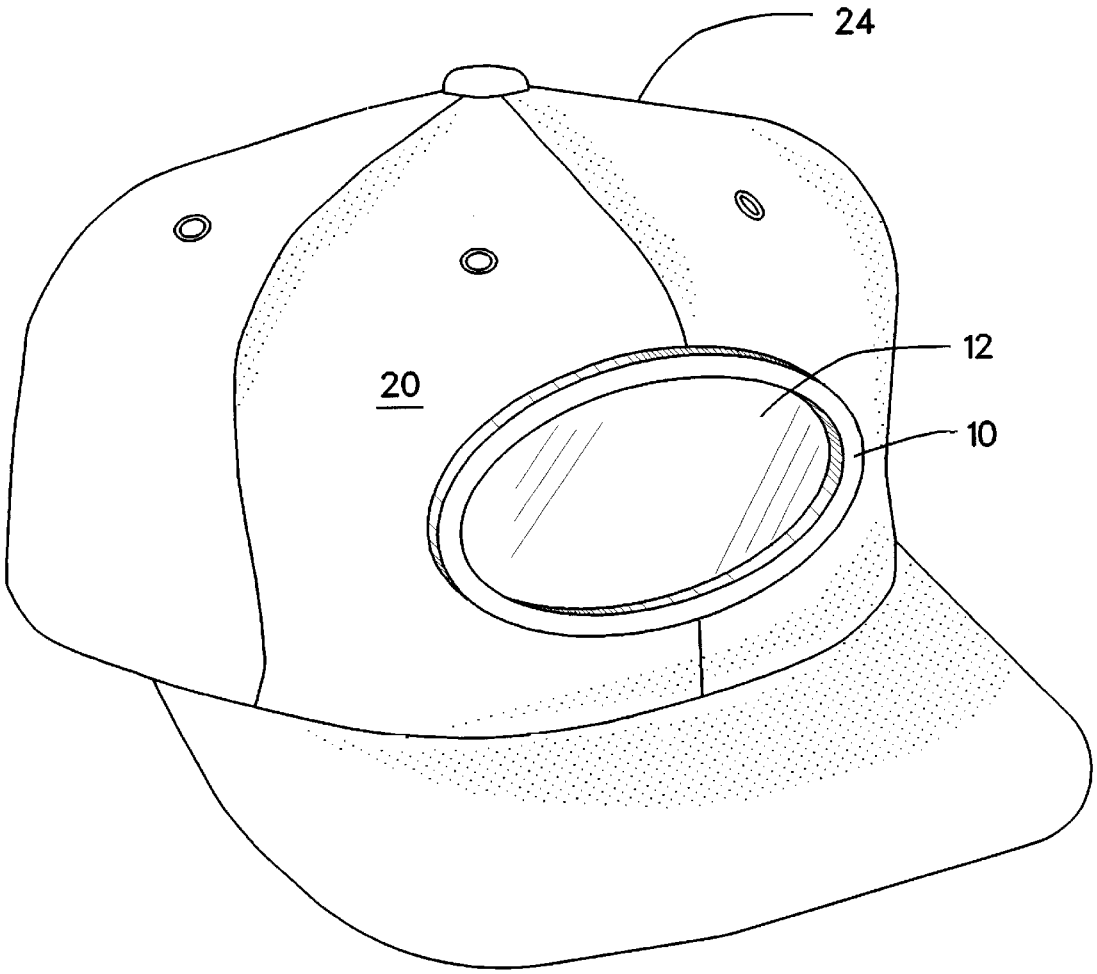
FIG. 1 is a perspective view of an apparatus for inserting a display item on a cap or apparel in accordance with the present invention, shown with a generally rectangular frame member attached to a cap.
Figure 2:
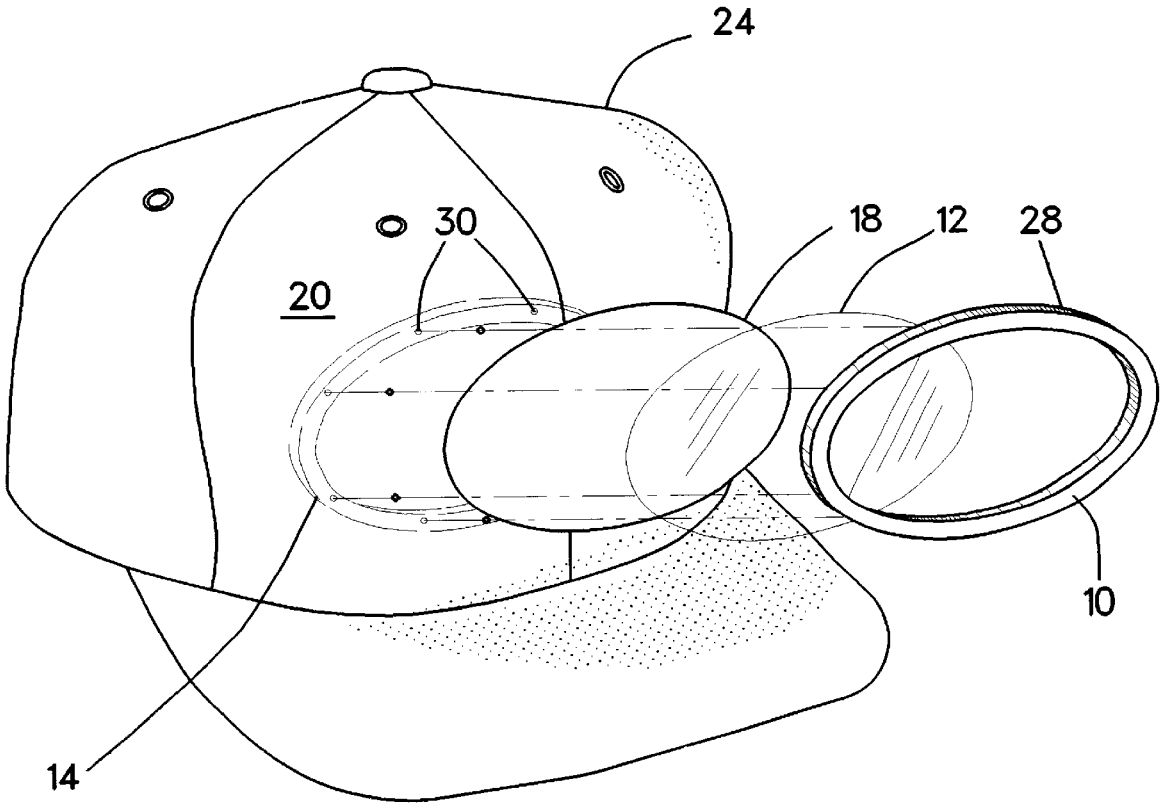
FIG. 2 is a perspective view of the apparatus in FIG. 1, showing the internal section of the crown portion.

Referring first to FIG. 1 and FIG. 2, an apparatus for inserting a display item on a cap or apparel, in accordance with the present invention, is generally shown with a cap. The apparatus generally comprises a fabric of a cap 10 having a crown portion 12, a frame assembly 14, a cell 16, and means 18 for inserting a generally planar display item 20. Cap 10 is typically of a traditional baseball-style that includes crown portion 12. Display item 20 may include a wide variety of informational or advertising material imprinted thereon, or ornamental displays, such as but not limited to, business cards, photographs, insignias, logos, banners, and the like.

Frame assembly 14 includes a member 22, an opening 24, and a transparent layer 26. Member 22 is of a unitary construction and extends continuously around in a generally rectangular shape, wherein opening 24 is defined therein. Opening 24 is adapted to show display item 20 therethrough. Transparent layer 26 encompasses opening 24 and is attached to member 22 of frame assembly 14. Transparent layer 26 is preferably attached member 22 of frame assembly 14 by stitch 28, although other forms of attachment are contemplated, such as but not limited to, glueing, heat fusing, stapling or integrally molding. Member 22 is attached to fabric of crown portion 12 preferably by stitch 30. Stitch 30 for attaching member 22 to the fabric is preferably accomplished by embroidery, which provides a more aesthetically pleasing appearance. Member 22 may be composed of a fabric material, a synthetic material, or a like material having generally flexible characteristics, and transparent layer 26 is composed of a synthetic material, also for flexibility. It is contemplated that member 22 may be positioned at any location on crown portion 12 of cap 10.

Cell 16 is defined between fabric of crown portion 12 and transparent layer 26 and is adapted to receive and hold display item 20. The total area available for display item 20 is limited by cell 16, which is bordered by member 22 of frame assembly 14. Since member 22 of frame assembly 14 has a rectangular shape, display item 22 should preferably also be rectangular shaped. To maximize the total area display available, opening 24 also has a generally rectangular configuration matching that of member 22. The color of member 22 preferably matches that of crown portion 12 for an aesthetically blended appearance. Alternatively, the color of member 22 may be selected to provide a stark contrast to the color of crown portion 12.

Means 18 for inserting display item 20 comprises at least a first gap 32. First gap 32 exists in fabric of crown portion 12 and is positioned such that first gap 32 is in communication with cell 16. First gap 32 is adapted to receive display item 20 inserted therein and preferably lies adjacent an edge of cell 16. A corresponding flap 34 is formed as a result of first gap 32, and the length of first gap 32 many vary to some extent. Flap 34 may be peeled back away from fabric of crown portion 12 as sufficient to allow for the complete insertion of display item 20 into cell 16. Means 18 for inserting display item 20 may further comprise a second gap (not shown), that exists in fabric of crown portion 12. The second gap is also in communication with cell 16 and is preferably positioned at an edge of cell 16 that is opposite to that of first gap 32. The combination of first gap 32 and the second gap not only allows for the insertion and/or removal of display item 20 therethrough, but also the mounting of display item 20 that may be sized somewhat wider or longer than cell 16, depending on the orientation of first gap 32 and the second gap. It can therefore be seen that first gap 32 and/or the second gap allows for the internal access (inside crown portion 12) for insertion and removal of display item 20 from cell 16. Display item 20 may include a plurality of graphical or informational items, and the positioning of display item 20 within cell 16 allows for the display of any particular graphical or informational item that is contained on display item 20, depending on the wearer's preference.

Figure 3:
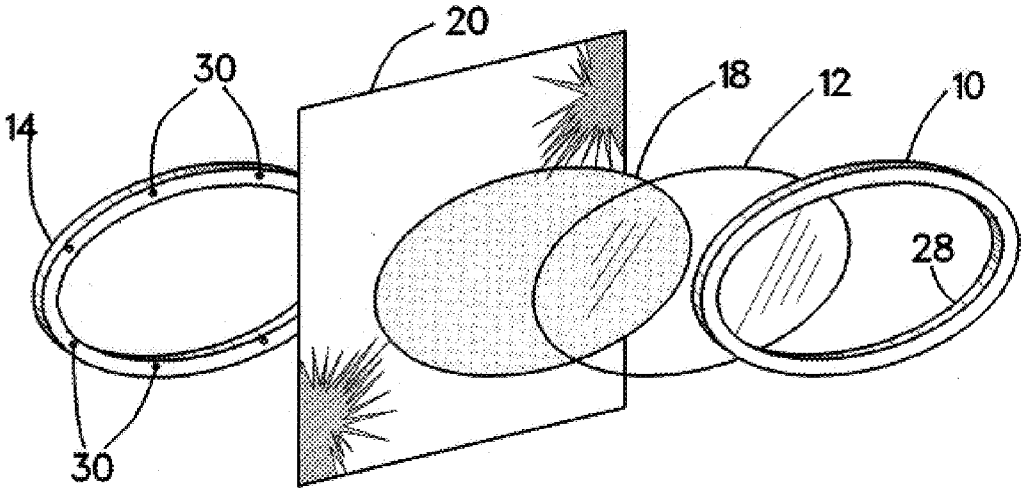
FIG. 3 is a perspective view of an apparatus for inserting a display item on a cap or apparel in accordance with the present invention, shown with a generally oval frame member attached to a cap.
Figure 4:
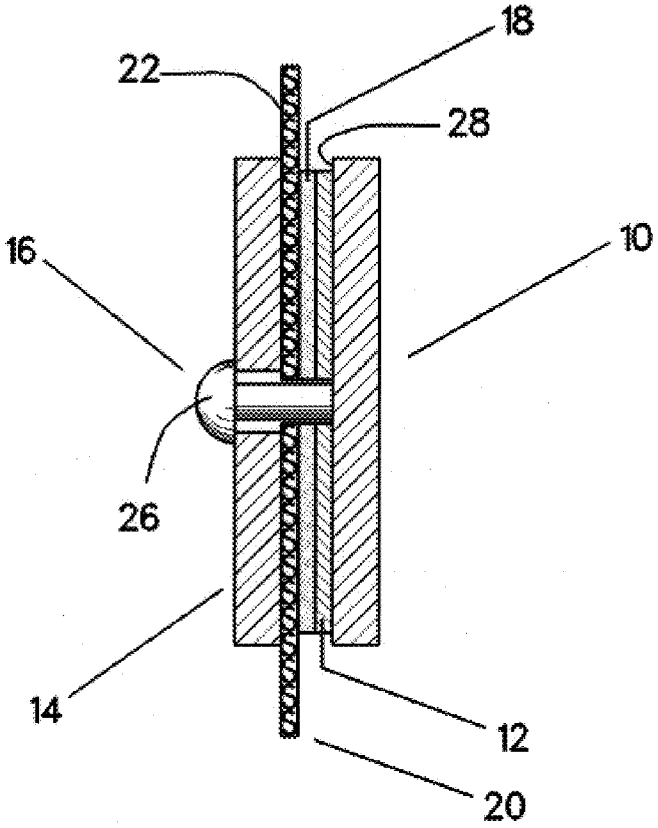
FIG. 4 is a perspective view of the apparatus in FIG. 3, showing the internal section of the crown portion.

Referring also to FIG. 3 and FIG. 4, it can be seen that a frame assembly 36 may have varying configurations. For example, frame assembly 36 includes a member 38 that is of a unitary construction and extends continuously around in a generally oval shape. Since display item 40 is for insertion and placement within a cell 42, display item 40 should also be oval-shaped. In all other aspects, frame assembly 36 includes all the features and functionality as that of frame assembly 14, shown in FIG. 1 and FIG. 2, and is therefore not discussed in further detail. It is noteworthy, however, that in this configuration of frame assembly 36, a first gap 42 extends from an edge of cell 42 to the thickest point 46*a* and 46*b* of cell 42, so as to accommodate the insertion of display item 40 without the necessity of its folding or crumpling.

Figure 5:
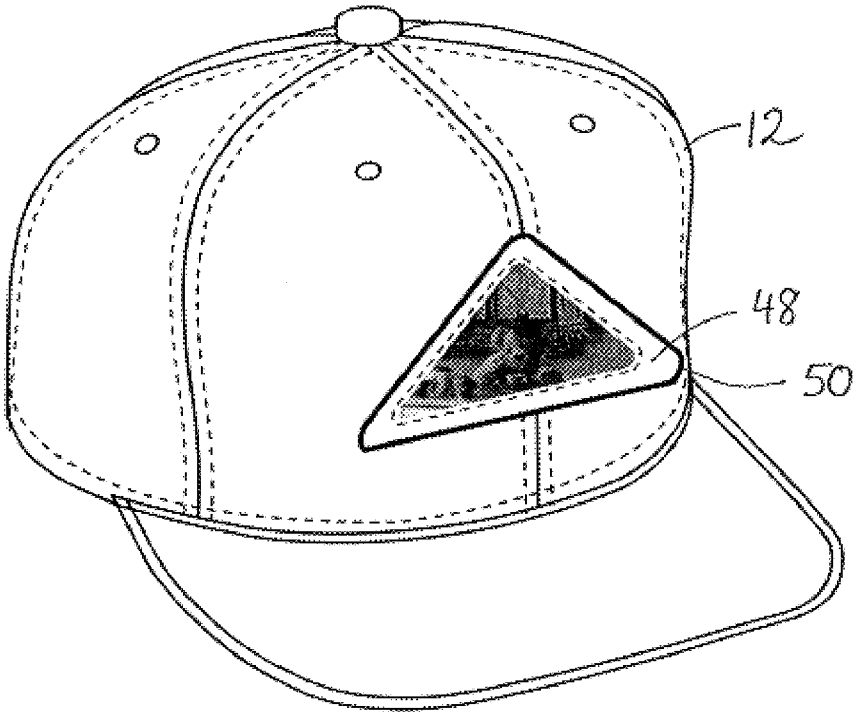
FIG. 5 is a perspective view of an apparatus for inserting a display item on a cap or apparel in accordance with the present invention, shown with a generally triangular frame member attached to a cap.
Figure 6:
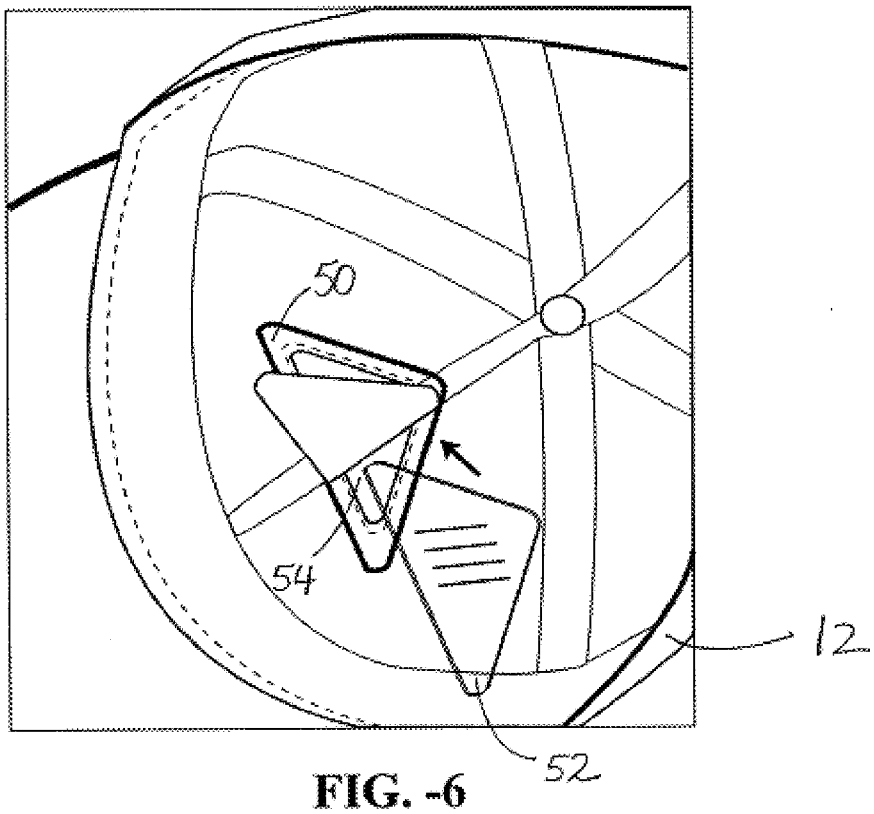
FIG. 6 is a perspective view of the apparatus in FIG. 5, showing the internal section of the crown portion.

Referring also to FIG. 5 and FIG. 6, it can be seen that a frame assembly 48 may include a member 50 having a generally triangular shape. Since the display item 52 is for insertion and placement within a cell 54, display item 52 should also be triangular-shaped. In all other aspects, frame assembly 48 includes all the features and functionality as that of frame assembly 14, shown in FIG. 1 and FIG. 2, and is therefore not discussed in further detail.

Figure 7:
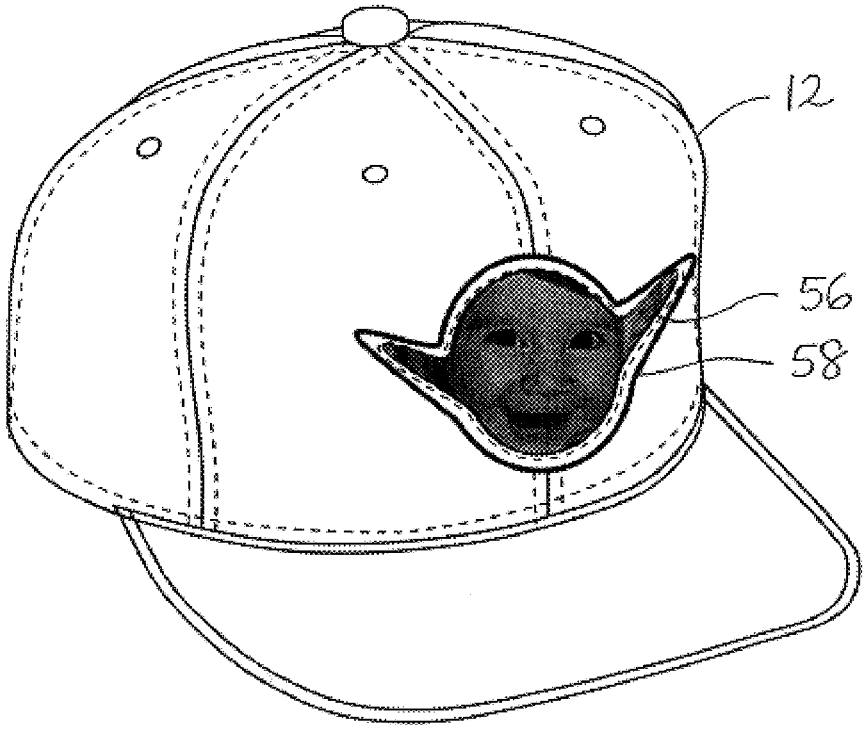
FIG. 7 is a perspective view of an apparatus for inserting a display item on a cap or apparel in accordance with the present invention, shown with a frame member having a generally gold ingot shape attached to a cap.
Figure 8:
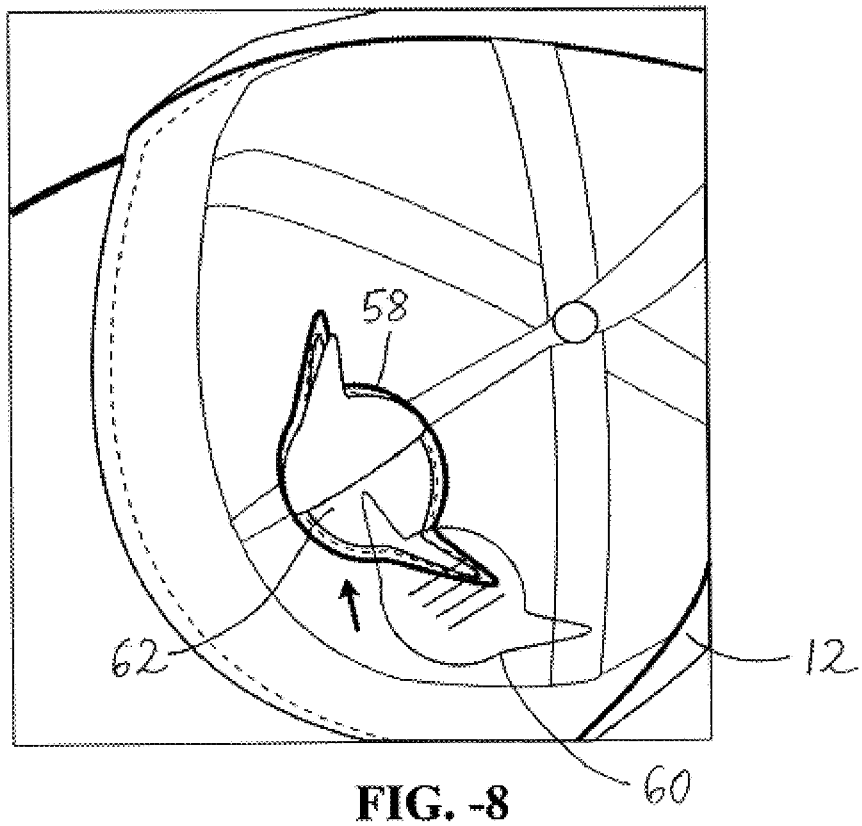
FIG. 8 is a perspective view of the apparatus in FIG. 7, showing the internal section of the crown portion.

Referring also to FIG. 7 and FIG. 8, it can be seen that a frame assembly 56 may include a member 58 having a generally gold ingot shape. Since the display item 60 is for insertion and placement within a cell 62, display item 60 should also have a gold ingot shape. In all other aspects, frame assembly 56 includes all the features and functionality as that of frame assembly 14, shown in FIG. 1 and FIG. 2, and is therefore not discussed in further detail.

Figure 9:
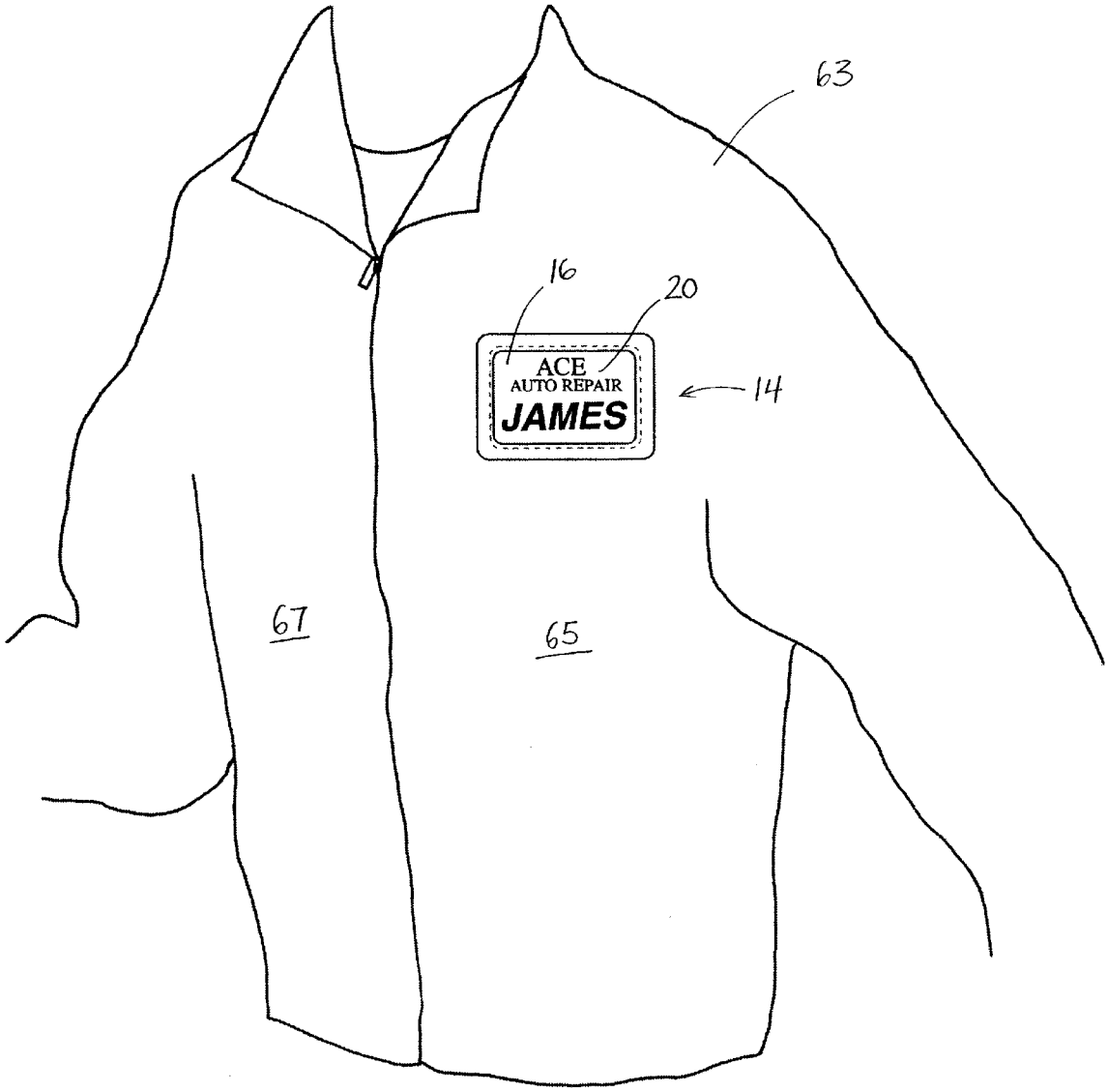
FIG. 9 is a perspective view of an apparatus for inserting a display item on a cap or apparel in accordance with the present invention, shown with a frame member having a generally rectangular shape attached to a jacket.
Figure 10:
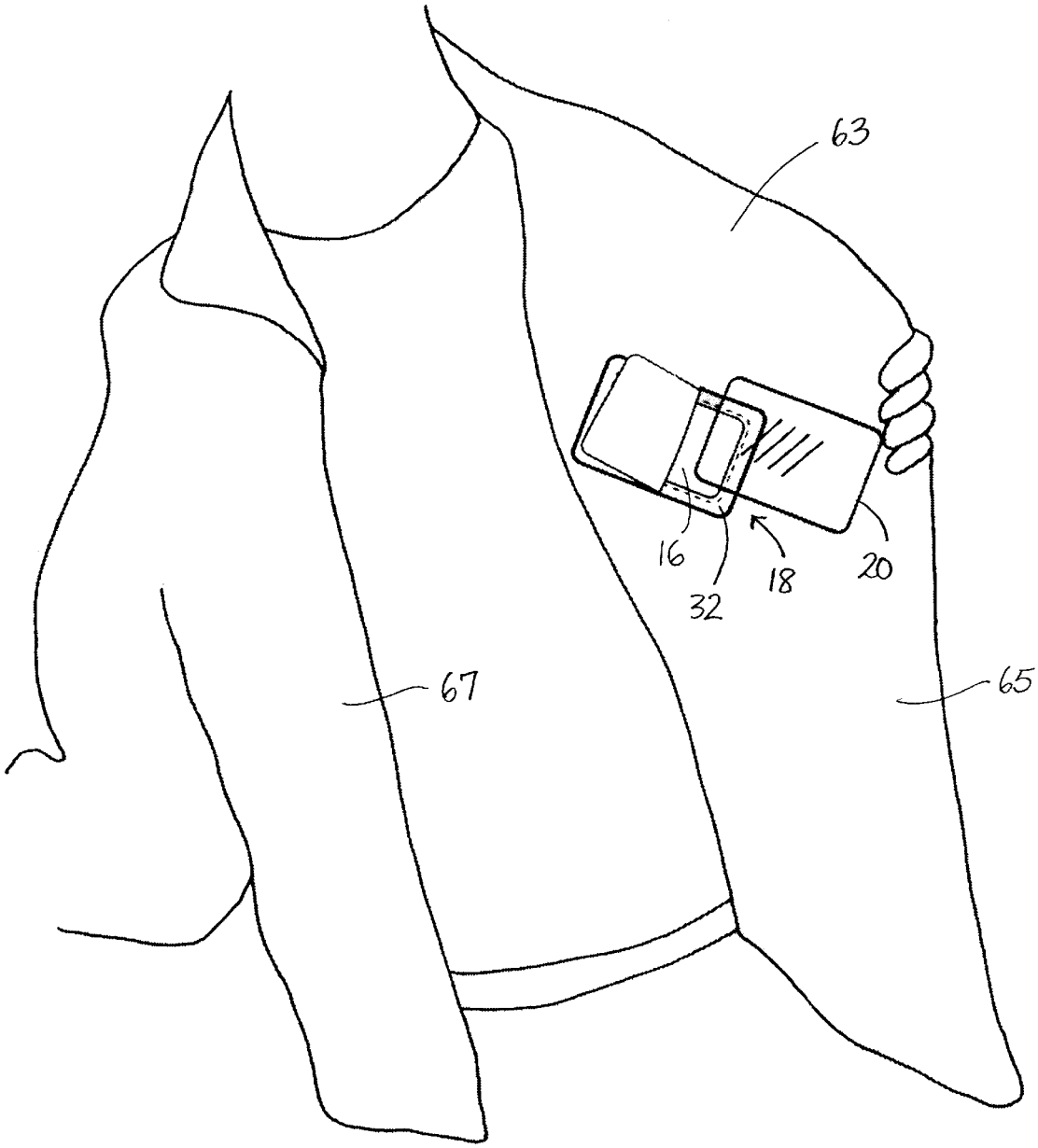
FIG. 10 is a perspective view of the apparatus in FIG. 9, shown from inside the jacket.

Referring also to FIG. 9 and FIG. 10, an apparatus for inserting a display item on a cap or apparel, in accordance with the present invention, is generally shown with an apparel such as a jacket 63. The apparatus generally comprises fabric of an apparel, such as a jacket 63, frame assembly 14, cell 16, and means 18 for inserting a generally planar display item 20. Fabric of jacket 63 typically includes a left flap 65 and a right flap 67. Frame assembly 14 may be attached to the fabric of either left flap 65 or right flap 67 ofjacket 63 in the manner discussed for crown portion 12 of cap 10. It is contemplated that frame assembly 14 may otherwise be attached to any other portion ofjacket 63. It is further contemplated that the fabric of jacket 63 may accommodate any configuration of a frame assembly.

In this example, means 18 for inserting display item 20 comprises at least first gap 32 that exists in the fabric of either left flap 65 or right flap 67 of jacket 63 in position such that first gap 32 is in communication with cell 16. Means 18 for inserting display item 20 may further comprise a second gap (not shown), that also exists in fabric of either left flap 65 or right flap 67 of jacket 63 and which is also in communication with cell 16. The combination of first gap 32 and the second gap allows for the mounting of display item 20 that may be sized somewhat wider or longer than cell 16, depending on the orientation of first gap 32 and the second gap relative to each other. It can therefore be seen that first gap 32 and/or the second gap allows for the internal access (inside jacket 63) for insertion and removal of display item 20 from cell 16.

Figure 11:
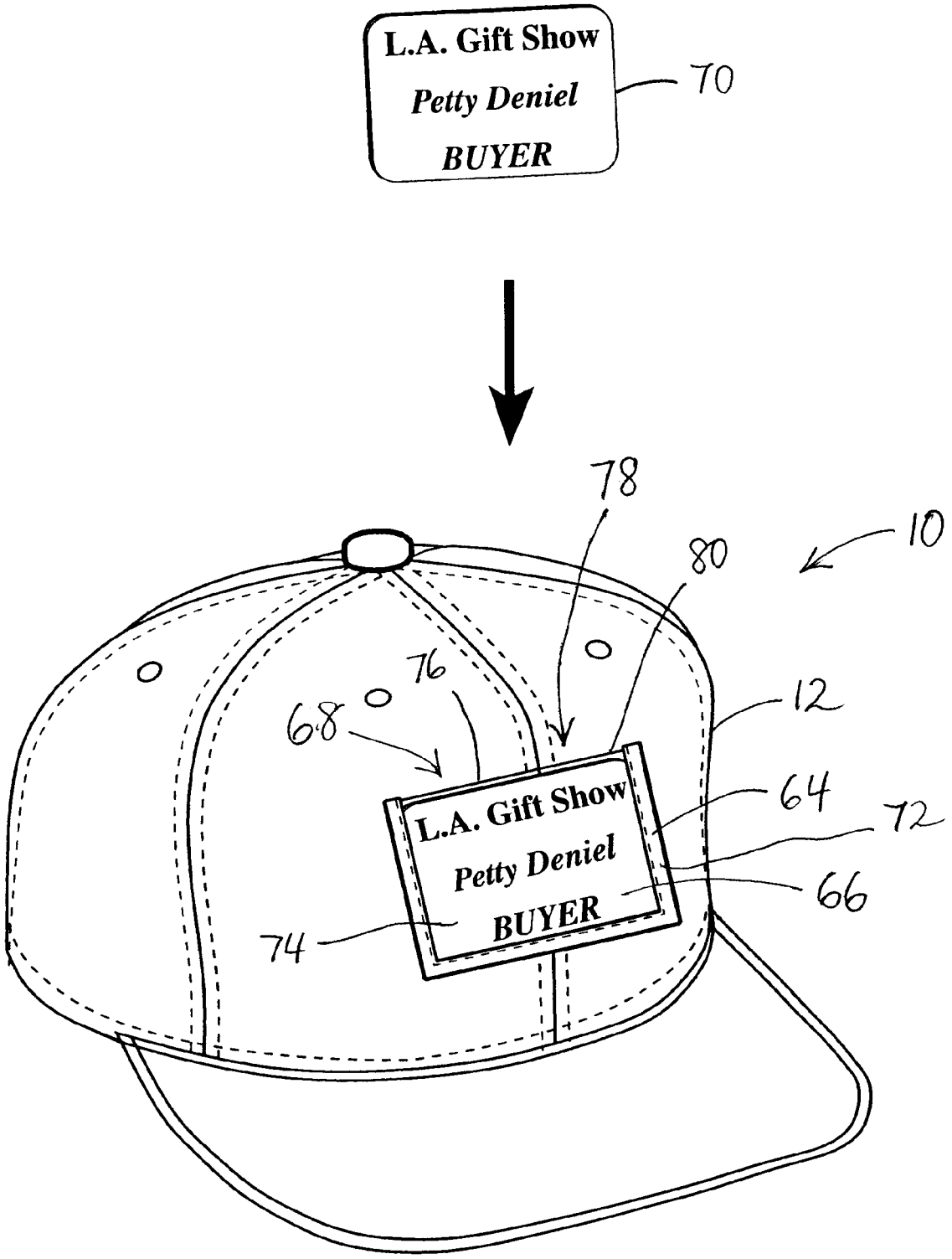
FIG. 11 is an alternative embodiment of an apparatus for inserting a display item on a cap or apparel in accordance with the present invention, shown with a generally rectangular frame member having a horizontally disposed aperture, attached to a cap.

Referring now to FIG. 11, an alternative embodiment of an apparatus for inserting a display item on a cap or apparel in accordance with the present invention, is generally shown attached to cap 10. Alternative embodiment comprises a fabric of a cap 10 having a crown portion 12, a frame assembly 64, a cell 66, and means 68 for inserting a generally planar display item 70. Frame assembly 64 includes a member 72 that extends non-continuously around, an opening 74 defined therein, and a transparent layer 76 that encompasses opening 74. Means 68 for inserting a generally planar display item 70 includes at least a first aperture 78 disposed along member 72, which renders member 72 non-continuous therearound. First aperture 78 is in communication with cell 66 and is horizontally disposed, preferably positioned along an upper edge 80 of frame assembly 64. It can therefore be seen that first aperture 78 allows for the external access (outside crown portion 12) for insertion and removal of display item 70 from cell 66. Frame assembly 64 may also accommodate display item 70 that is larger than the area provided by cell 66, as display item 70 may extend above upper edge 80 of frame assembly 64.

Figure 12:
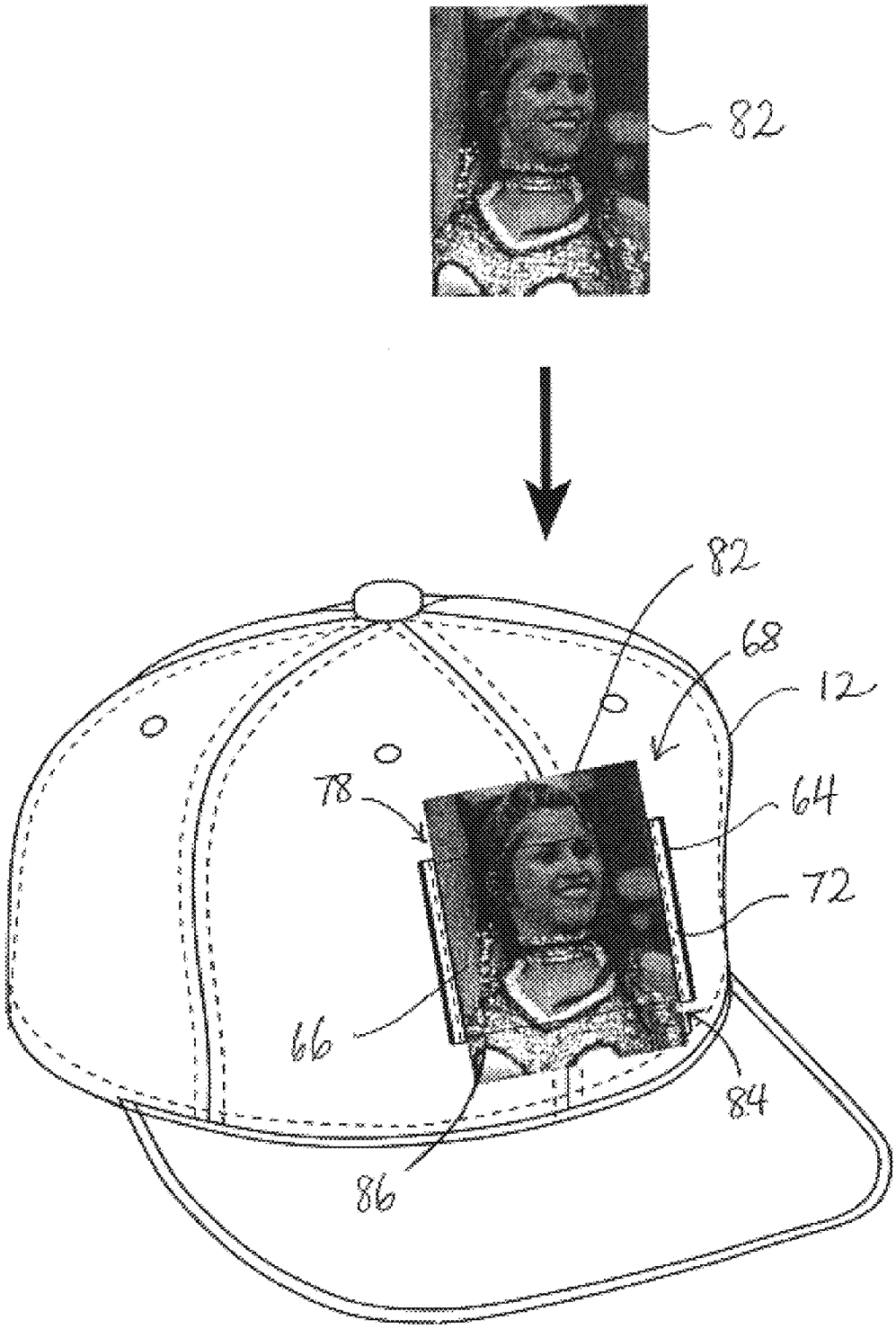
FIG. 12 is an alternative embodiment of an apparatus for inserting a display item on a cap or apparel in accordance with the present invention, shown with a generally rectangular frame member having a pair of horizontally disposed apertures, attached to a cap.

Referring also to FIG. 12, means 68 for inserting a generally planar display item 82 may further include a second aperture 84 disposed along member 72. Second aperture 84, which is also in communication with cell 66, is positioned in a horizontally opposed fashion relative to first aperture 78. The combination first aperture 78 and second aperture 84 allow for the placement of display item 80 that significantly larger than the area of cell 66. As such, display item 80 may simultaneously extend above upper edge 80 of frame assembly 64, as well as below the lower edge 86 of frame assembly 64.

Figure 13:
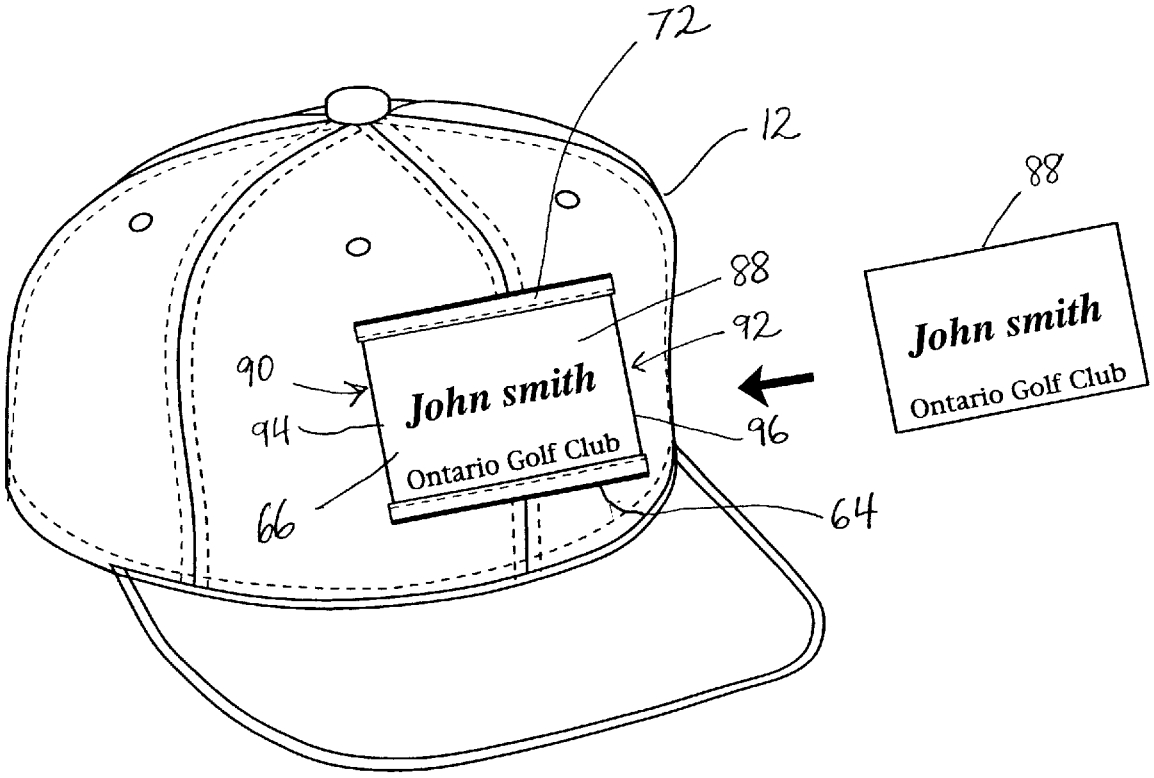
FIG. 13 is an alternative embodiment of an apparatus for inserting a display item on a cap or apparel in accordance with the present invention, shown with a generally rectangular frame member having a pair of vertically disposed apertures, attached to a cap.

Referring also to FIG. 13, means 68 for inserting a generally planar display item 88 may comprise first aperture 90 and second aperture 92 disposed along member 72 in a vertically opposed fashion relative to each other. The combination first aperture 90 and second aperture 92 allow for the placement of display item 88 that significantly larger than the area of cell 66. As such, display item 88 may simultaneously extend beyond the left edge 94 and the right edge 96 of frame assembly 64, if necessary. The incorporation of only one aperture 90 or 92 on either left edge 94 or right edge 96, respectively, of frame assembly 64 is contemplated.

Figure 14:
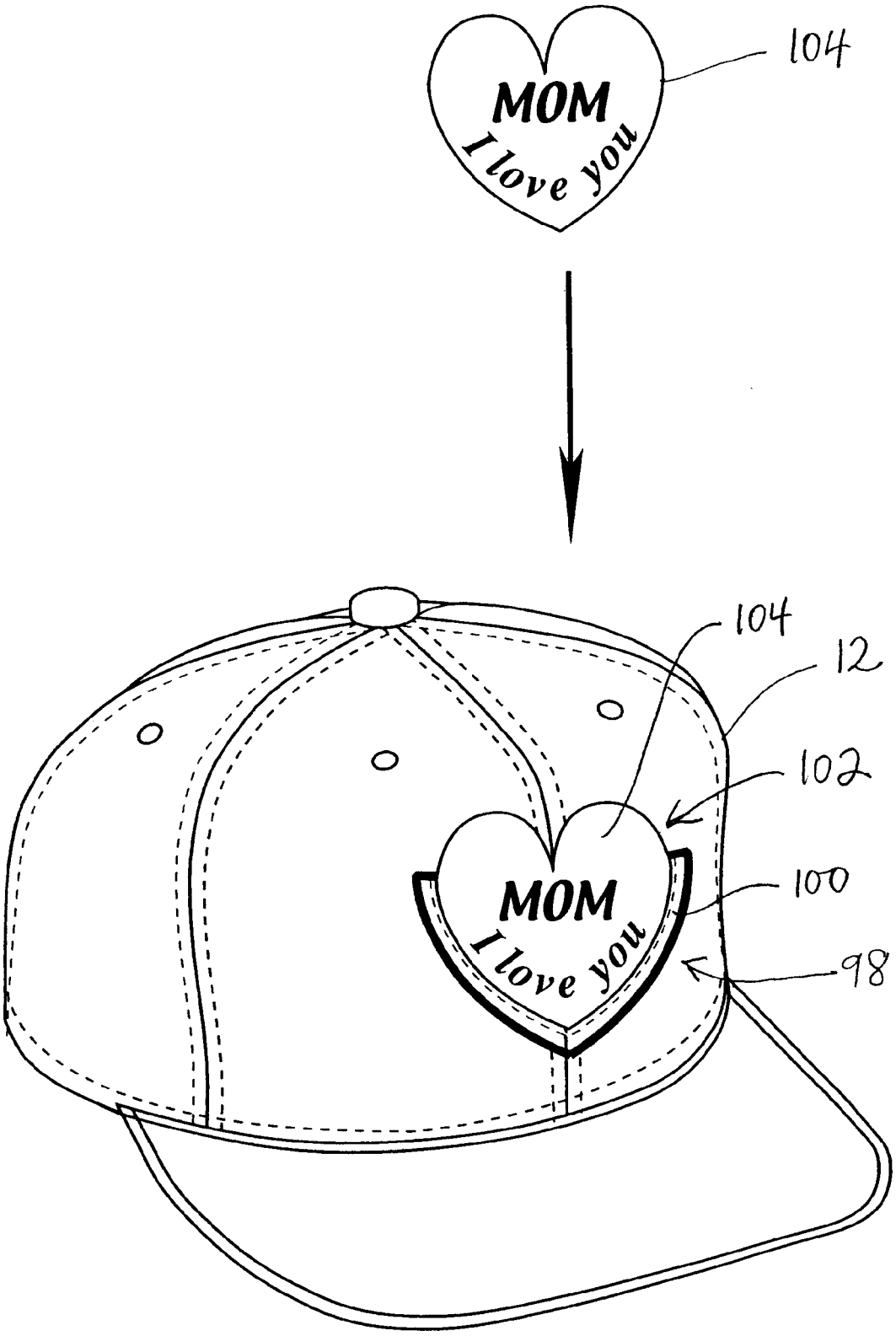
FIG. 14 is an alternative embodiment of an apparatus for inserting a display item on a cap or apparel in accordance with the present invention, shown with a generally heart-shaped frame member, attached to a cap.

It can be seen that various configurations for frame assembly 98 are contemplated, as shown in FIG. 14. Frame assembly 98 includes a member 100 having a generally V-shaped configuration and a first aperture 102 disposed therein. As such, V-shaped member 100 allows for the insertion, and hence, the display of a planar display item 104 with a heart-shape into first aperture 102.

Figure 15:
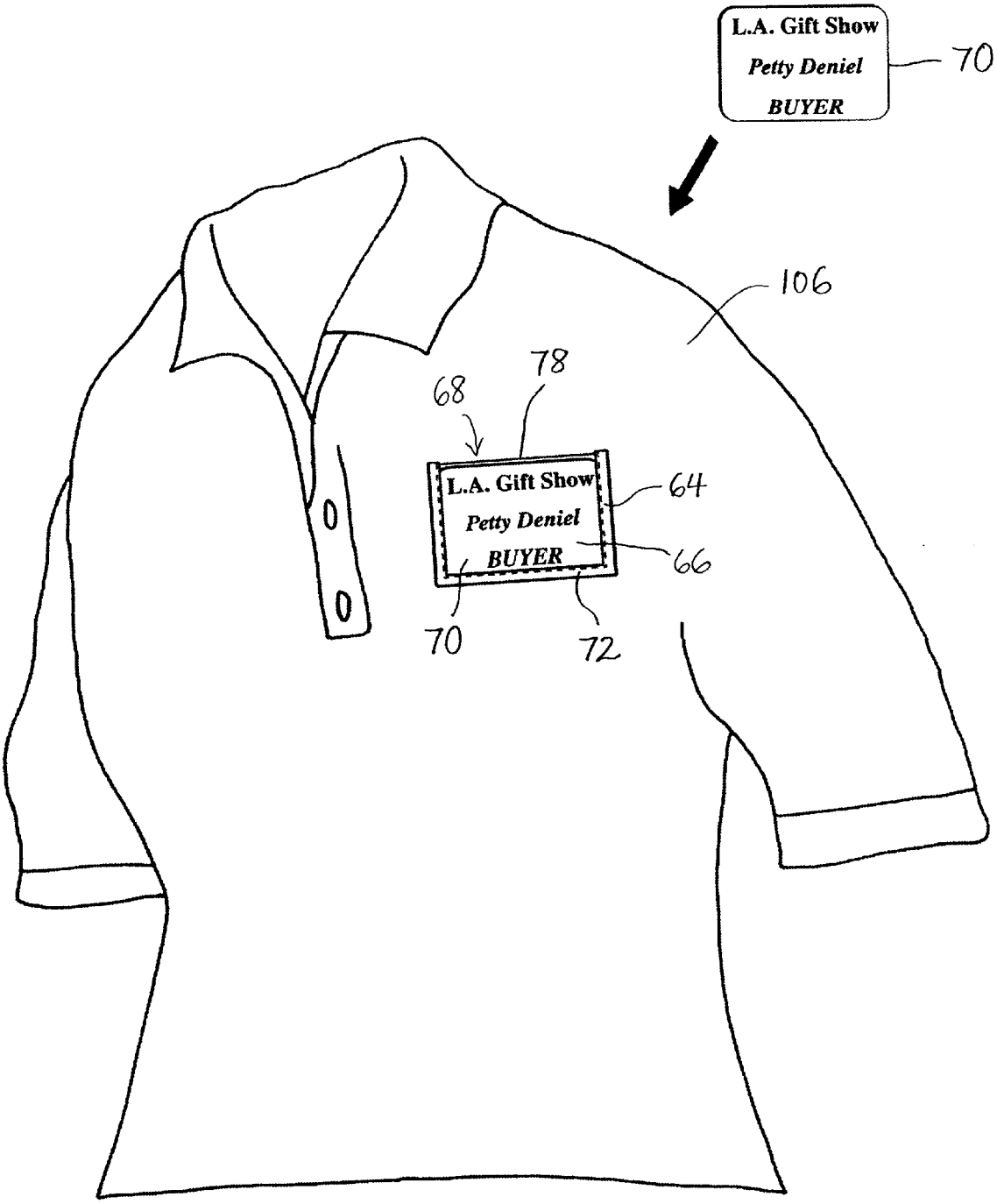
FIG. 15 is an alternative embodiment of an apparatus for inserting a display item on a cap or apparel in accordance with the present invention, shown attached to a shirt.

Referring also to FIG. 15, alternative embodiment of an apparatus for inserting a display item on a cap or apparel in accordance with the present invention, is generally shown attached to the fabric of an apparel such as a shirt 106. Alternative embodiment comprises the fabric of shirt 106, frame assembly 64, a cell 66, and means 68 for inserting a generally planar display item 70. Frame assembly is attached to the fabric of shirt 106 in a like manner as that described for attachment to cap 10 and jacket 63. Means 68 for inserting a generally planar display item 70 includes at least first aperture 78 disposed along member 72, which renders member 72 non-continuous therearound. First aperture 78 is in communication with cell 66 and is horizontally disposed, preferably positioned along an upper edge 80 of frame assembly 64. It can therefore be seen that first aperture 78 allows for the external access (outside shirt 106) for insertion and removal of display item 70 from cell 66. Frame assembly 64 may also accommodate display item 70 that is larger than the area provided by cell 66, as display item 70 may extend above upper edge 80 of frame assembly 64. It is contemplated that shirt 106 may accommodate any configuration of a frame assembly.

Accordingly, it will be seen that this invention provides for the display of a generally planar item on a cap or apparel, wherein the insertion and removal of the display item may be accomplished from either inside the crown portion of the cap or apparel, or from outside the crown portion of the cap or the apparel. Although the description above contains many specificities, these should not be construed as limiting the scope of the invention but as merely providing illustrations of some of the presently preferred embodiments of this invention. Thus the scope of this invention should be determined by the appended claims and their legal equivalents.

What is claimed is:

1. An apparatus for inserting a display item on a cap or an apparel, comprising:

a fabric having an outside face, an inside face and a seam;

a generally transparent material formed into a shape having at least two sides and a border and secured over said outside face, wherein said inside face of the fabric has an incision on the border of only one side of said shape and;

a cell formed by said incision between the inside face of said fabric and said transparent material, said cell secured to said inside face of said fabric by said seam which substantially bisects said cell into a first portion and a second portion wherein a slit is formed by said incision in said first portion of said cell and said second portion of said cell is secured to the inside face of said fabric whereby the display item is inserted within said slit between said inside face of said fabric and said transparent material such that said display item visible through said transparent material.

2. The apparatus of claim 1 further including a frame placed around said border of said shape.

* * * * *